United States Patent [19]

Torii

[11] 4,196,925

[45] Apr. 8, 1980

[54] DOOR LOCK MECHANISM FOR VEHICLES

[75] Inventor: Nozomu Torii, Hekinan, Japan

[73] Assignee: Aisin Seiki Kabushiki Kaisha, Aichi, Japan

[21] Appl. No.: 914,753

[22] Filed: Jun. 12, 1978

[30] Foreign Application Priority Data

Jun. 15, 1977 [JP] Japan ..... 52-70641

[51] Int. Cl.[2] ..... E05C 3/26

[52] U.S. Cl. ..... 292/216; 292/336.3; 292/DIG. 23

[58] Field of Search ..... 292/216, 280, DIG. 23-27, 292/336.3

[56] References Cited

U.S. PATENT DOCUMENTS

| | | | |
|---|---|---|---|
| 3,027,185 | 3/1962 | Allen et al. | 292/DIG. 23 X |
| 3,312,489 | 4/1967 | Trudeau | 292/48 |
| 3,666,307 | 5/1972 | Zaydel | 292/216 |
| 3,999,791 | 12/1976 | Torii | 292/280 X |
| 4,005,887 | 2/1977 | Itakura | 292/DIG. 26 X |

*Primary Examiner*—William E. Lyddane

*Attorney, Agent, or Firm*—Oblon, Fisher, Spivak, McClelland & Maier

[57] ABSTRACT

An improved door lock mechanism having an opener plate which can pivot to move a detent to a locking or unlocking position, the detent being able to open or close the door latch. The opener plate is further movable to an activating or non-activating position by a first locking lever connected to a garnish button for movement against a turn-over snap action spring and a second locking lever covering the first locking lever and connected to a key cylinder for movement with the cylinder without lost motion.

4 Claims, 5 Drawing Figures

DOOR LOCK MECHANISM FOR VEHICLES

BACKGROUND OF THE INVENTION

1. Field of the Invention

This invention relates generally to door lock mechanisms and more particularly to a door lock mechanism for vehicles.

2. Description of the Prior Art

Conventionally, a vehicle door lock device is disposed in a vehicle door and is connected to a door locking mechanism such as a door handle, key cylinder and garnish button (not shown). Normally, the key cylinder, which is actuated by a key to unlock or lock the door lock device is connected to the door lock device by means of a key lever and link member which are also disposed in the door. Conventionally the key cylinder is connected to a single locking lever. The locking lever is used for door opening and closing operation of the actuating door latch member through a known pawl and detent mechanism. In such a conventional mechanism, if the key lever or link member is directly actuated by inserting a wire or similar object within a space between the door frame and window glass for the purpose of stealing the vehicle, the door lock device may easily be moved to the unlocking postiion due to the lost motion between the key cylinder and key lever.

SUMMARY OF THE INVENTION

It is therefore an object of the present invention to provide an improved door lock mechanism for vehicles obviating the above drawbacks.

According to the present invention, the door lock device comprises a key cylinder, a key lever connected thereto for unitary rotation therewith without permitting any lost motion therebetween, a pair of locking levers one of which is operatively connected to an inside locking member to be movable between a locking and an unlocking position in response to the locking member, the other of which is operatively connected to the key lever to be movable between a locking and an unlocking position in response to the actuation of a key to prevent the door being opened from the outside unless the key is actuated to operate the second locking lever.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference numerals designate like or corresponding parts throughout the several views, and wherein.

DETAILED DESCRIPTION OF THE PREFERRED EMBODIMENTS

Figure 1:
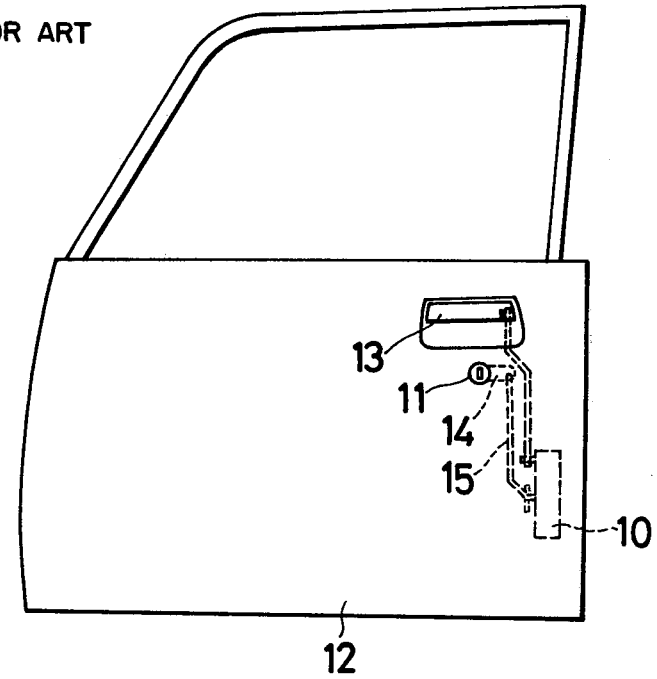
FIG. 1 PRIOR ART
FIG. 1 shows a prior art door lock device 10 attached to the door of a vehicle.
Figure 2:
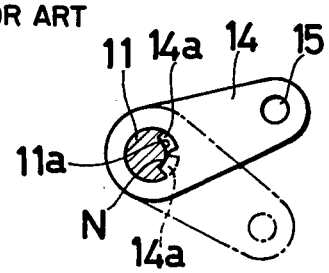
FIG. 2 PRIOR ART
FIG. 2 shows the connecting relation between a key lever and key cylinder of a prior art door lock device.

Referring to FIGS. 1 and 2 which show a prior art door locking device, the door locking mechanism 10 is attached to the inside of a vehicle door. It is operatively connected to a door handle 13 through a link and to a key cylinder 11 by means of link member 15.

As best shown in FIG. 2, the key cylinder is connected to the link member through a key lever 14 to which one end of link member 15 is rotatably secured. Key lever 14 is movable to either a locked position or an unlocked position (shown by the solid and broken lines in FIG. 2). The other end of key lever 14 is rotatably connected to key cylinder 11. Key cylinder 11 has a cut out portion **11*a* adjacent the connection to the key lever 14 and key lever 14 as an extension 14*a* extending into a portion of the cut out 11*a* so that key cylinder 11 may rotate for a portion of a turn before the ends of cut out 11*a* and extensions 14*a* abut to move the key lever, thereby resulting in lost motion between the key cylinder and the key lever. This prior art arrangement permits the key link 15 and key lever 14** to be movable without rotation of the key cylinder. The prior art mechanism is thereby susceptible to being directly actuated by means of a wire of similar object inserted into the door. A potential thief may thereby gain entrance to the vehicle without the use of a key.

Referring now to the present invention, a door lock device 20 (FIGS. 3 or 5) is attached to the interior of an automobile door 12. The device 20 comprises a base plate 21, an opener plate 22 pivoted thereon through pin 23, a detent member 24 pivoted on the base plate 21 through pin 25, and first and second locking levers 26, 27 pivoted on the base plate 21 through common pin 28.

A connecting lever 30 is pivotably connected to one end of the opener plate 22 by a pin 29 secured thereto to form an opener plate means. The connecting lever 30 is provided with an elongated bore **30*a* which is slidably disposed about a pin 31 secured to the first locking lever 26. The pin 29 of the opener plate 22 further rotatably supports thereon a link member 32 which is operatively connected to an outside handle (not shown, but similar to numeral 13 of FIG. 2). The other end of the opener plate 22 is engaged with a link member 33 which is operatively connected to an inside door handle (not shown). The opener plate 22 is rotated in a counterclockwise direction about pin 23 as viewed in FIG. 3, upon opening operation of either the outside or inside door handle. A pin 34 which is secured to the detent member 24 is fixed to a pawl 100 which engages a latch member 101 which cooperates with a striker pin 102 mounted on the vehicle to prevent the latch member from opening the door. Upon counterclockwise rotation of the detent member 24 and about the pin 25 the pawl 100 is disengaged from the latch member 101 which pivots about pin 103 and the door is openable since pawl 100 also rotates about pin 25**.

Figure 4:
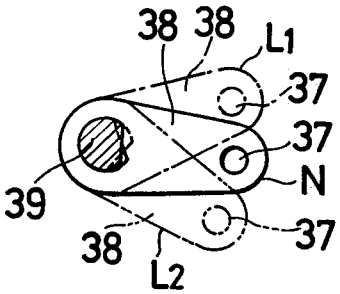
FIG. 4 shows the connecting relation between a key lever and key cylinder of the present invention; and, FIG. 5 shows an explanatory view similar to FIG. 3 but showing the door lock device in a locking condition.

The detent member 24 is provided with first and second engaging portions **24*a*, 24*b* which are respectively engageable with first and second engaging portions 30*b*, 30*c* provided on the connecting lever 30. The first locking lever 26 is connected to a link member 35 which is operatively connected to an inside manual locking means, for example, a garnish button. When such garnish button is actuated to position the door lock device 20 in the locked condition, the first locking lever 26 is rotated to the position illustrated in FIG. 5 against the biasing force of over-center-type tensioning spring 36. One end of spring 36 is engaged with the base plate 21 and the other end is engaged with lever 26, respectively. Spring 36 biases the lever 26 in a counterclockwise direction about end 28 and when the element 35 is pushed down the spring 36 provides a snap-over action (FIGS. 3–5) to thereby bias the lever 26 in a reverse (i.e. clockwise) direction. The first locking lever 26 is provided with first and second engaging portions 26*a*, 26*b* which are respectively engageable with first and second engaging portions 27*a*, 27*b* provided on the second locking lever 27. The second locking lever 27 is connected to a link member 37 which is operatively connected to a key lever 38 as shown in FIG. 4. The key lever 38 is fixedly connected to a key cylinder 39** for integral rotation with the cylinder upon actuation of key with no lost motion between the key lever and key cylinder.

Figure 3:
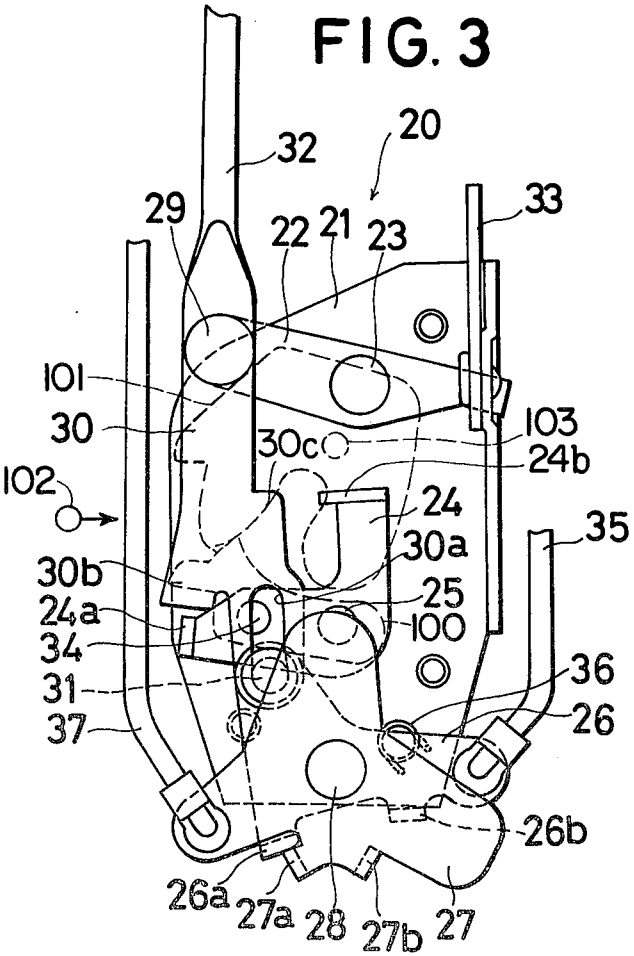
FIG. 3 shows an explanatory view of the mechanical structure of the door lock device according to the present invention.

Referring next to operation of the invention, FIG. 3 shows the device in an unlocked position. When either one of the door handles is actuated the opener plate 22 is rotated in the counterclockwise direction about the in 23 from the position illustrated in FIG. 3. The connecting lever 30 is thereby moved downwardly so that the first engaging portion **30*b* thereof engages the first engaging portion 24*a* of the detent member 24. Due to such engagement, the detent member 24 is rotated in a counterclockwise direction about the pin 25** to release the engagement between the pawl and latch member. Thus the latch is rotated in a door opening direction to open the door.

During the above operation the second engaging portion **30*c* of the connecting lever 30 will not be engaged with the second engaging portion 24*b* of the detent member 24. The pin 31 of the first locking lever 26 is relatively slidable within the elongated bore 30*a*, and therefore, the downward movement of the connecting lever 30 will not influence the first locking lever 26**.

Figure 5:
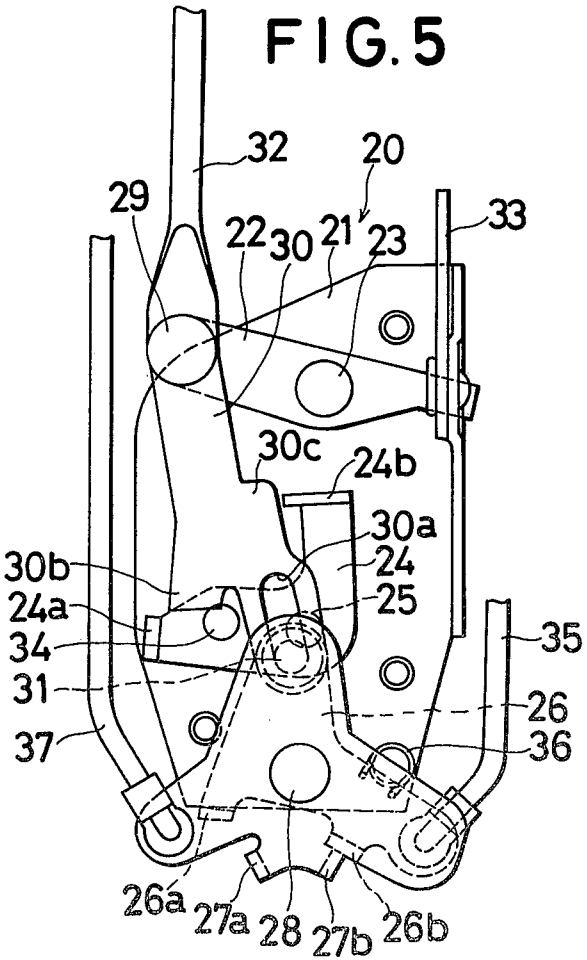

When the driver of the vehicle wishes to lock the door from the inside, he actuates the garnish button to move the link member 35 downwardly (from the position of FIG. 3 to FIG. 5). This rotates the first locking lever 26 in a clockwise direction against the biasing force of the spring 36. Due to the rotation of the first locking lever 26 the connecting lever 30 is rotated about the pin 29 in a counterclockwise direction through the engagement between the elongated bore **30*a* and the pin 31 secured to the first locking lever 26 (FIG. 5). The first engaging portion 30*b* of the connecting lever 30 is then out of the engaging area of the first engaging portion 24*a* of the detent member 24**.

In this condition as viewed in FIG. 5, even when the open plate 22 is rotated in a counterclockwise direction by either one of the door handles the detent member 24 will not be actuated. Accordingly, the latch member maintains the engagement with the pawl.

When the door locking operation is to be performed by using the key, the key is inserted into the key cylinder 39 and is rotated together with the cylinder 39 from a neutral position (indicated by solid line N) to a first chain line $L_1$ in a first position (indicated by broken line $L_1$) a counterclockwise direction as viewed in FIG. 4. The connecting link member 37 is thereby moved upwardly as viewed in FIG. 3. The second locking lever 27, connected to the link member 37, is rotated about the pin 28 in a clockwise direction as viewed in FIG. 3. Due to the clockwise rotation of the second locking lever 27, the first engaging portion **27*a* thereof is engaged with the first engaging portion 26*a* of the first locking lever 26 thereby to rotate the first locking lever 26 in a clockwise direction overcoming the biasing force of spring 36. The first locking lever 26 is then located in the position illustrated in FIG. 5 and maintains its position by the action of spring 36. Under such conditions, when the key is rotated back to the neutral position (FIG. 4) the link member 37 is moved downwardly to rotate the second locking lever 27 in a counterclockwise direction, disengaging the first engaging portion 27*a* of the second locking lever 27 from the first engaging portion 26*a* of the first locking lever 26 (as shown in FIG. 5). But the first locking lever 26 remains in place due to the spring 36** thus providing a lost motion between the two locking levers.

In this condition, the first locking lever 26 is positioned in the locking position and the connecting lever 30 is out of engaging position with the first engaging portion **24*a* of the detent member 24. Accordingly, the door will not open even when the outside door handle is actuated. Further, even when the key lever 38 or link member 37 is directly actuated by a wire or similar object, through, for example a space between the window glass and the door frame, the key lever 38 or link member 37 will not be moved to unlocking position due to the integral operation (i.e. with no lost motion) of key cylinder 39, key lever 38, and link member 37. It is also impossible to directly actuate the first locking lever 26 because it has been covered by the second locking lever 27 as is shown in FIG. 5**.

If the driver wishes to open the door under such conditions from the inside of the vehicle by actuating the garnish button, the link member 35 is moved upward from the position of FIG. 5. Then the first locking lever 26 is rotated in the counterclockwise direction. The pin 31 of the first locking lever 26 will rotate the connecting lever 30 about the pin 29 in a clockwise direction to move the first locking lever 26 in the unlocking position as shown in FIG. 3. Thereafter the inside door handle may be actuated to rotate the opener plate 22 in a counterclockwise direction to open the door.

If the above door opening is desired to be performed using a key from the outside, the key is actuated to rotate the key cylinder 39 from the first position of line $L_1$ to the second position of line $L_2$ over the neutral position N. The second locking lever 27 is thereby rotated through link member 37. In this condition, the second engaging portion **27*b* of the second locking lever 27 engages with the second engaging portion 26*b* of the first locking lever 26 to move the first locking lever 26 to its unlocking position. The first engaging portion 30*a* of the connecting lever 30 is then operable with the first engaging portion 24*a* of the detent member 24** for releasing the engagement between the pawl and latch member to open the door.

It is also possible for this invention to perform a so-called self-cancellation and a keyless locking operation. When the door is opened with the door lock device in a locking position, as shown in FIG. 5, and the driver of the vehicle erroneously closes the door, the detent member 24 is rotated about the pin 34 in a counterclockwise direction due to the cooperational movement of the latch member and a striker (not shown) secured to the vehicle body. This rotates the connecting lever 30 in a clockwise direction due to the engagement of the second engaging portion **24*b* of the detent member 24 with the second engaging portion 30*c* of the lever 30**.

Thus the first engaging portion 30*b* of the lever 30 is engageable with the first engaging portion 24*a* of the detent member 24. Simultaneously, due to the rotational movement of the connecting lever 30, the first locking lever 26 is rotated in a counterclockwise direction to be in the unlocking position whereby the cancellation operation is performed.

When the driver wishes to close and lock the door without using a key, he first actuates the garnish button to be in locking condition while actuating the outside door handle (i.e., maintaining the connecting lever 30 to its lower moved position). In this condition, the first engaging portion 30*b* of the connecting lever 30 is out of engagement with the first engaging portion 24*a* of the detent member 24. Thereafter when the door is closed, while actuating the outside door handle, the detent member 24 is rotated about the pin 34 in a counterclockwise direction without engaging with the second engaging portion 30*c* of the connecting lever 30. Therefore the connecting lever 30 maintains its locking position during door closing operation. After the door is closed the door handle may be released and the door lock device will remain in locked position shown in FIG. 5. According to the described embodiment of the invention, there is provided a lost motion function between the first and second locking levers 26, 27, as a result of the biasing action of the turn-over snap action spring. However, it is possible to provide such lost motion between the second locking lever 27 and the connecting lever 30.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A door lock mechanism for a vehicle door having inside and outside door opening handles and a latch member comprising:

a key cylinder located on the outside of the door for locking and unlocking the door lock mechanism by a key;

a key lever located in said vehicle door and operatively connected to said key cylinder;

a door lock device provided in said vehicle door and including an opener plate means operatively connected to said outside door opening handle;

a detent member operatively connected to said latch member for operating the latch member to move between a locking and an unlocking position, said detent member being operatively connected to said opener plate means;

a first rotatable locking lever operatively connected to said opener plate means and an inside locking means, a second rotating locking lever operatively connected to said key lever and said first locking lever, each of said first and second locking levers including a first engaging portion for direct abutting engagement with each other upon relative rotational movement in one direction and a second engaging portion for direct abutting engagement with each other upon relative rotational movement in the other direction, and a common pivot means about which said first and second rotatable locking levers are rotated such that said first locking lever may be rotated to connect or disconnect said opener plate means to said detent member while said second locking lever may be rotated to actuate said first locking lever in response to the actuation of the key.

2. A door locking mechanism according to claim 1, wherein said opener plate means includes a connecting lever member operably connected to said first locking lever and wherein said connecting lever member and said detent member include first engaging portions respectively for direct abutting engagement with each other when said first locking lever is in its unlocking position.

3. A door locking mechanism according to claim 2, wherein said connecting lever member and said detent member include second engaging portions respectively for direct abutting engagement with each other when said first locking lever is in its locking position.

4. A door locking mechanism according to claim 3, further comprising an over-center-type tension spring operatively associated with said first and second locking levers for causing lost motion therebetween.

* * * * *